United States Patent [19]

Vosper

[11] 4,339,113

[45] Jul. 13, 1982

[54] SCREW OPERATED JACK

[76] Inventor: George W. Vosper, 149 Earl St., Kingston, Ontario, Canada, K7L 2H3

[21] Appl. No.: 159,646

[22] Filed: Jun. 16, 1980

Related U.S. Application Data

[63] Continuation-in-part of Ser. No. 60,487, Jul. 25, 1979, abandoned.

[51] Int. Cl.[3] ..... B25B 1/02

[52] U.S. Cl. ..... 254/13; 254/98; 29/238; 29/239; 29/257; 269/88; 269/147; 269/204; 269/252

[58] Field of Search ..... 254/13, 98, 100; 269/9, 269/88, 146–149, 165–167, 203, 204, 171.5, 207–212, 246, 250, 252; 29/238, 239, 256, 257

[56] References Cited

U.S. PATENT DOCUMENTS

| | | | |
|---|---|---|---|
| 1,187,109 | 6/1916 | Stevernagel | 269/204 |
| 2,221,325 | 11/1940 | Holman | 269/167 |
| 3,061,302 | 10/1962 | Dennis | 269/88 |
| 4,042,264 | 8/1977 | Shumer | 269/203 |

*Primary Examiner*—Robert C. Watson

[57] ABSTRACT

A bar clamp of the type which uses standard pipe for the bar and modified for jacking. The jack includes first and second pipes of suitable length each threaded at at least one end thereof. The first pipe is substantially longer than the second pipe and has a first jaw member slidable therealong for quick positioning and lockable at any position. A mounting bracket having a threaded bore extending from one face thereof to and through an opposite face interconnects the first and second pipes. A second jaw member is slidable along the second pipe and movable by rotating a threaded rod that extends through an additional threaded bore in the bracket. A handle is swingably connected to one end of the threaded rod for use in rotating the same.

7 Claims, 7 Drawing Figures

SCREW OPERATED JACK

This is a continuation-in-part of applicant's application Ser. No. 60,487 filed July 25th, 1979 and now abandoned.

This invention relates to a jack devised from modifications to a bar clamp.

Bar clamps are well known and extensively used for a variety of purposes. They consist basically of a rod or pipe having two jaw members mounted thereon, one of which is freely slidable providing quick adjustment and lockable at any position, and the other movable by a rotatable threaded screw for slow adjustment and providing suitable leverage for clamping articles disposed between the jaw members. The known bar clamps however, are usable only to clamp an article between the jaw members.

The principal object of the present invention is to provide a jack utilizing the components of a bar clamp.

Accordingly, there is provided in the present invention a jack comprising: a first pipe threaded at one end thereof; a first jaw member slidable longitudinally along said first pipe for quick positioning and having means to lock the same at any position therealong; a mounting bracket having first and second threaded bores extending therethrough parallel to and spaced apart from one another; a second pipe threaded at one end thereof, said first and second pipes being threaded into said first threaded bore respectively from opposite ends thereof; a second jaw member slidable along said second pipe; a threaded rod extending through said second threaded bore in the bracket and rotatably connected to said second jaw member to move the same during rotation of the threaded rod, said threaded rod being axially parallel with said pipes; and handle means swingingly connected at one end thereof to one end of said threaded rod for rotating the same, said first and second jaw members each having an article engaging face and wherein said faces are directed away from one another.

The invention is illustrated by way of example in the accompanying drawings wherein.

Figure 1:
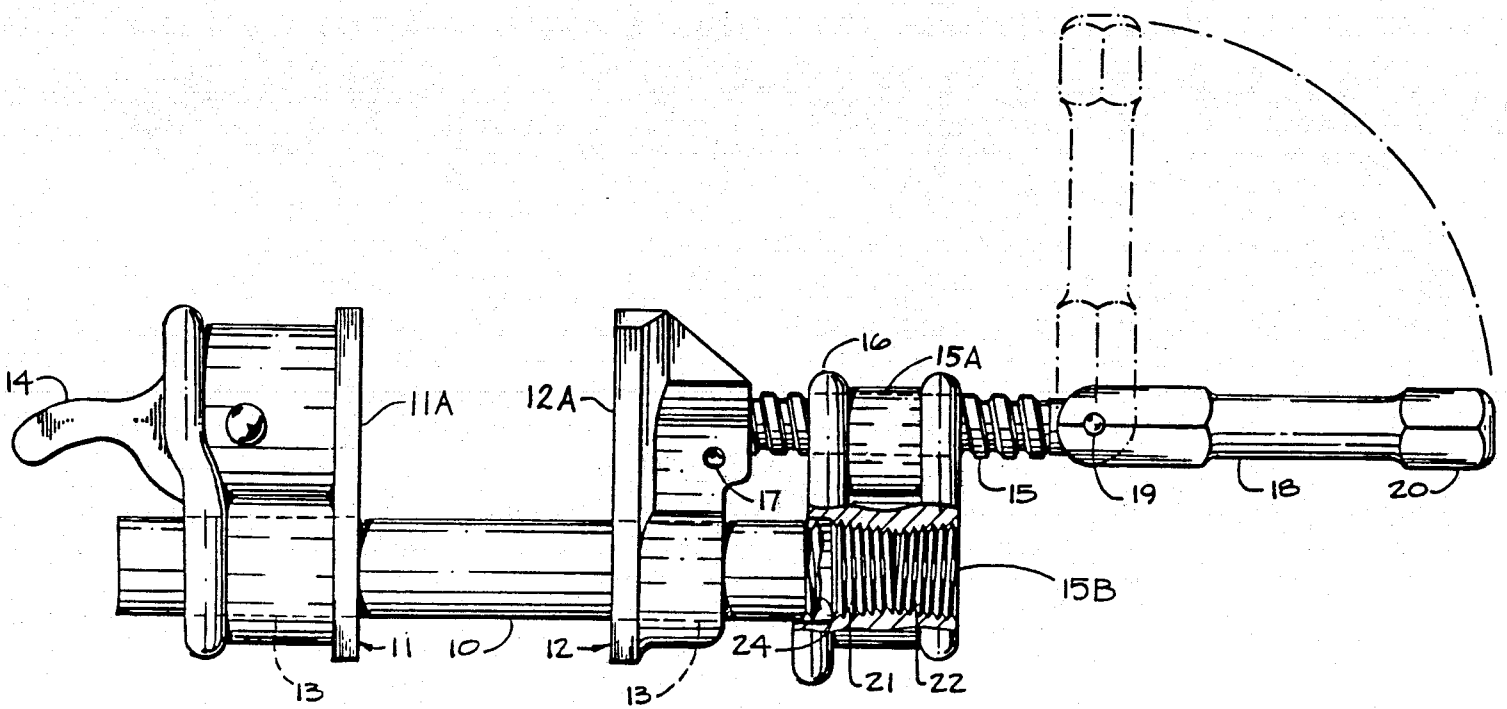
FIG. 1 is an elevational, partial sectional view of a bar clamp modified in accordance with the present invention.

Referring to the drawings, there is illustrated a bar type clamp consisting of a pipe 10 having first and second respective jaw members 11 and 12 movable therealong. Jaw members 11 and 12 have respective conventional article engaging faces 11A and 12A and each jaw member 11 and 12 has an aperture 13 appropriately sized to provide a sliding fit on the pipe 10. Jaw member 11 is freely slidable along the pipe and lockable at any position longitudinally therealong in a conventional manner by a spring loaded eccentric means 14. The construction of the jaw member 11 including the eccentric is conventional and thus need not be shown or described in detail herein.

Jaw member 12 is movable longitudinally along the pipe by a rotatable threaded rod 15 anchored to the pipe 10 by a bracket 16. The threaded rod 15 is rotatably attached to the jaw member 12 by a pin 17 in a conventional manner and passes through a first threaded bore 15A in the bracket. The threaded rod 15 is rotated by a handle 18 pivotally connected at one end to the threaded rod by a pin 19. This pivotal connection permits rotating the threaded rod of applicant's jack illustrated in FIG. 2. The outer end of the handle has flats thereon, (i.e. hexagonal, squared, or otherwise cross-sectionally shaped) as indicated at 20 to permit utilizing a wrench for rotating the screw when the handle is in axial or approximately axial alignment with the threaded rod.

The bracket 16 has a second threaded bore 15B extending therethrough parallel to and spaced from the threaded bore 15A. The threaded bore 15B may be a straight through standard pipe thread but preferably is tapered having respective first and second tapered threaded portions 21 and 22 tapped on a common centerline from opposite faces of the bracket.

Pipe 10 has a threaded end 24 (a standard pipe thread) which in FIG. 1 is threaded into threaded portion 21 of the bracket when the components are arranged in a conventional manner for clamping articles between the jaws. In applicant's jack (illustrated in FIGS. 2 and 4) the threaded end 24 of pipe 10 is threaded into the threaded portion 22 of the bracket and a second pipe 25, threaded at one end thereof, is threaded into the threaded portion 21. The pipe 25 provides a guide for the jaw member 12 of the jack. The threaded portions 21 and 22 in the bracket are axially aligned and thus pipe 25 is effectively an extension to pipe 10. The length of pipe 25 is relatively short compared to pipe 10 and is only slightly longer than the travel of the threaded rod 15 in the bracket. Since the article engaging faces 11A and 12A of the respective jaw members face away from one another it is necessary to move one jaw in a direction away from the other to apply a force via the jaw faces. Thus, when jaw face 11A is in engagement with one object and jaw face 12A in engagement with another object movement of jaw member 12 by rotation of threaded rod 15 causes a pushing force tending to separate the objects. One application of applicant's device being used as a jack is illustrated in FIG. 2.

As seen therein jaw face 11A is in engagement with a tongue and groove hardwood flooring board 30 and the other jaw face 12A is in engagement with a similar board 31 being placed on a sub-floor 32. appropriate rotation of the threaded rod 15 results in jacking boards 30 and/or 31 into tight fitting engagement with the previously placed flooring boards. In such application of the device, and as apparent from FIG. 2, there is little space between the pipe 10 and the sub-floor for the handle. For this reason the handle is swingably connected to the threaded rod and while only one pivot pin is shown in such connection obviously two pivot pins arranged at right angles to one another may be used providing a universal joint. The handle illustrated in FIG. 2 is modified somewhat from that illustrated in FIG. 1 in that the portion with flats 20 is spaced from the free end of the handle and such free end is provided with a squared recess 26 for direct coupling with a ratchet type socket wrench.

Figure 2:
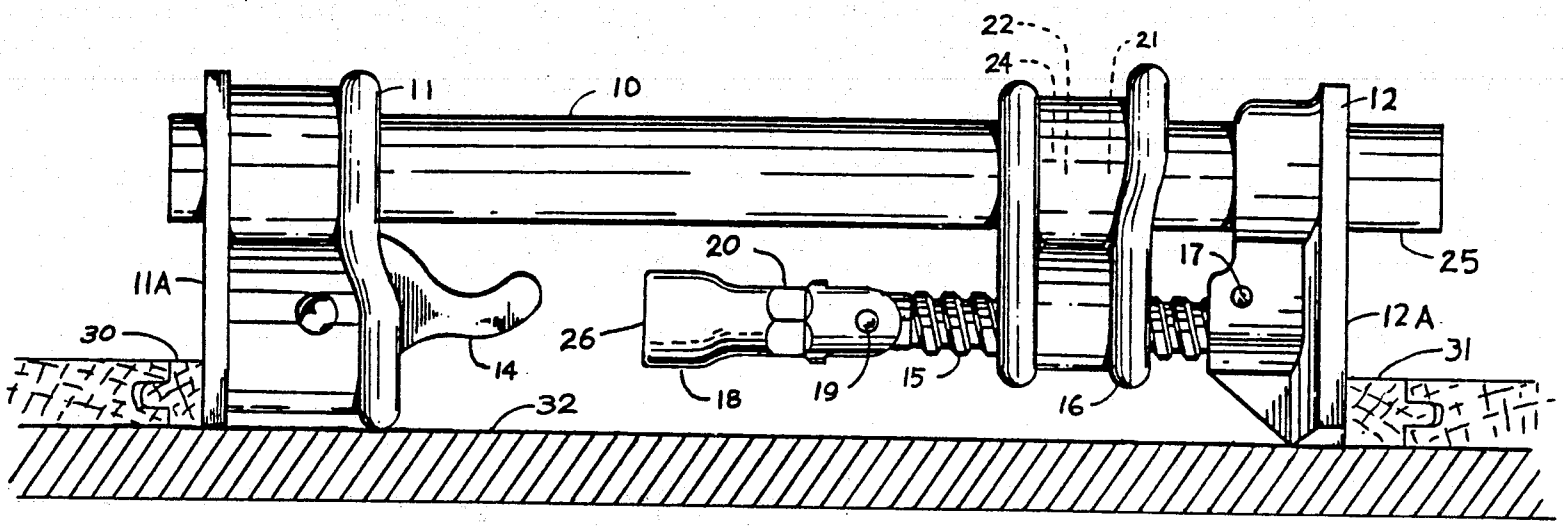
FIG. 2 is an elevational view similar to FIG. 1 but illustrating the device as a jack.
Figure 3:
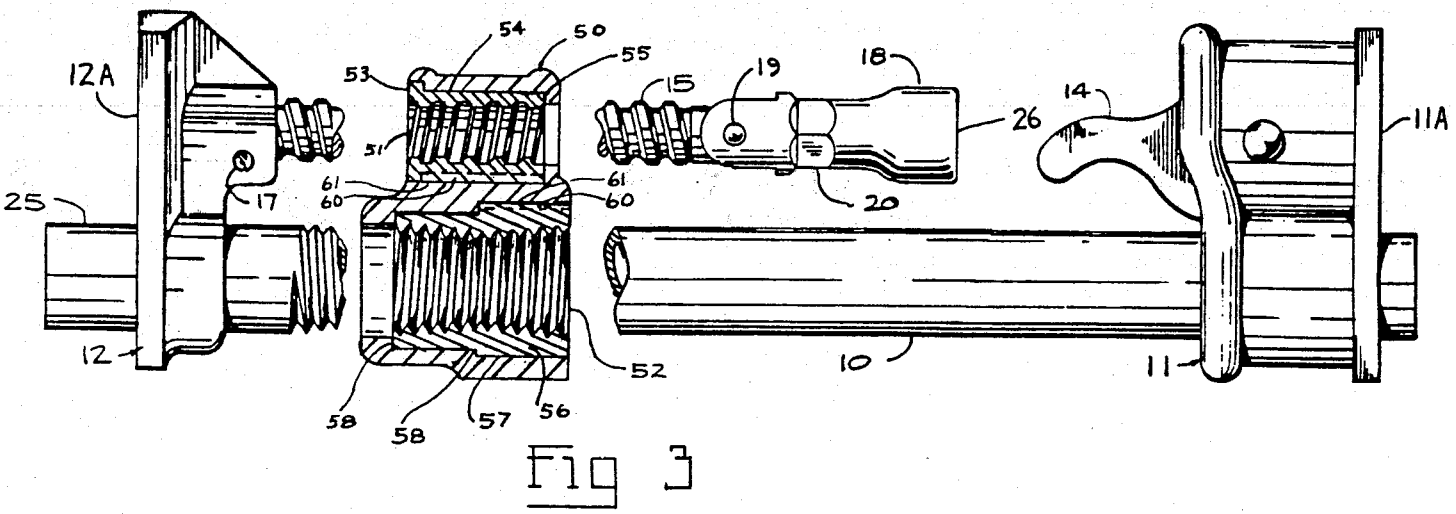
FIG. 3 is a view similar to FIG. 2 but incorporating modifications to the threaded bores in the bracket member.

In the device illustrated in FIGS. 1 and 2, bracket member 16 is provided with respective parallel spaced apart threaded bores 15A and 15B for the purposes previously described. The threads are cut directly in the bracket member and such threading operation is time consuming and costly. The modification illustrated in FIG. 3 substantially reduces such manufacturing cost. Referring now to FIG. 3, there is illustrated a modified bracket 50 having respective first and second spaced apart axially parallel threaded bores 51 and 52 each of which are provided by bushings of a plastics material having the threads molded therein. The threaded bore 51 is provided by a bushing 53 press fit into a recess 54 in the bracket. The bushing bears against a ledge 55 in the recess preventing axial displacement of the bushing when rotating the threaded rod 15 during jacking. The threaded bore 52 is provided by a bushing 56 press fit into a recess 57 in the bracket. Bushing 56 bears against a ledge 58 in the recess preventing axial displacement of the bushing in a direction opposite to that of bushing 53. Each of the bushings 53 and 56 are provided with some means preventing rotation of the bushing in the respective recesses. For this purpose the recesses may be non-circular in cross section or alternatively, as illustrated in FIG. 3, the outer peripheral surface of the respective bushings may be provided with a rib 60 projecting into a groove 61 in the recess.

The bushings 53 and 56 are molded from a plastics material and the threads are formed during the molding process. The bushings preferably are made of a plastics material known under the trade mark "Zytel" of E. I. du Pont de Nemours and Company Inc.

Figure 5:
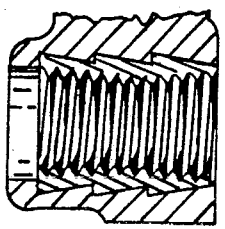

In the FIG. 3 embodiment the plastic threaded inserts or bushings engage a ledge in the recess of the bracket to prevent axial displacement of the insert. Another means of accomplishing the same result is illustrated in FIG. 5 wherein the bore is provided with a serrated edge thereby effectively forming a series of ledges.

Figure 6:
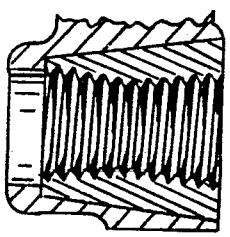
FIGS. 5 and 6 are partial sectional views of the bracket member illustrating means of retaining threaded sleeves therein.

Another embodiment is illustrated in FIG. 6 wherein the threaded plastic insert has effectively a conical outer surface tapered from one end to the other and fitting into a correspondingly tapered recess in the bracket. Obviously other axial displacement preventing means may be devised.

Figure 4:
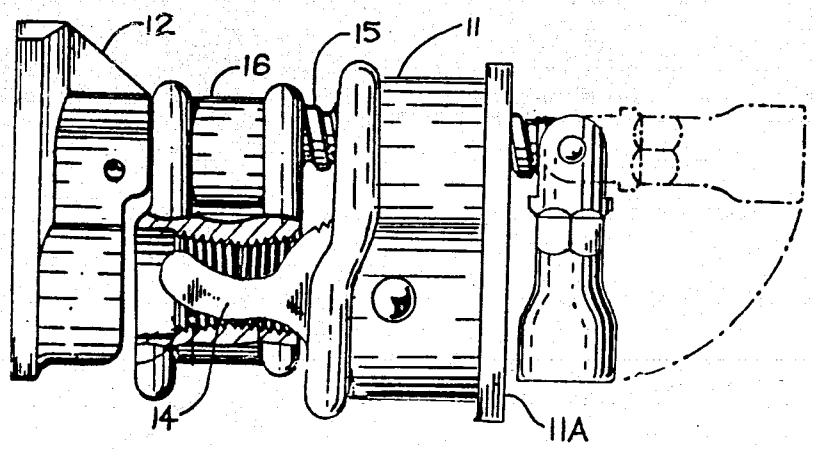
FIG. 4 is an elevational view of the components of the jack without the pipes and arranged for packaging.

Devices of the foregoing nature are normally sold without the pipes and thus what is packaged for marketing are the two jaw members and the bracket. An arrangement of such components for packaging is illustrated in FIG. 4 from which it will be noted the handle length preferably is such that when folded as illustrated in FIG. 4 it does not extend beyond the marginal edge of the jaw member 11. The threaded rod 15 passes through the aperture 13 in jaw member 11 and the portion of the eccentric lock mechanism 14 on such jaw member projects into the threaded bore 15B of the bracket member 16. The jaw member 12 is located on one side of the bracket opposite to that of jaw member 11. With the arrangement as illustrated and for a normal jack or clamp, packaging one unit requires a box approximately $5\frac{3}{4}'' \times 3\frac{1}{4}'' \times 1\frac{3}{4}''$. This is approximately $\frac{1}{2}$ (by volume) the size normally required.

Figure 7:
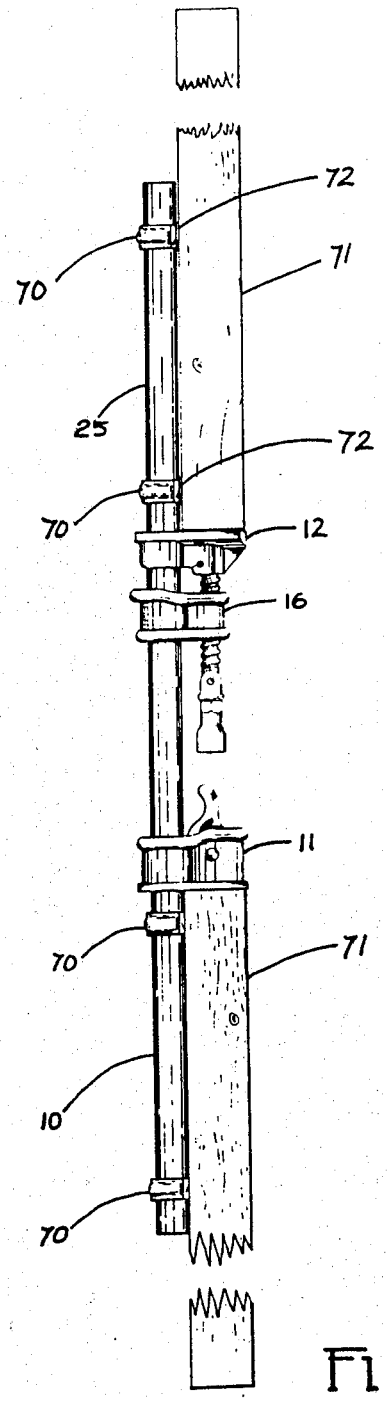
FIG. 7 is an elevational view of the jack employed as a jack post.

The jack illustrated in FIG. 7 is attached to two pieces of lumber 71 (2"×4") or other suitable posts to provide a temporary jack post. Pipe 25 of the jack is slidably attached to the member 71 by a pair of pipe clamps 70. Spacers 72 provide a sliding fit whereby member 71 can slide longitudinally along the pipe 25 during jacking. Pipe 10 is attached to the other member 71 by a pair of pipe clamps 70. If desired, spacers 72 may be used to provide a sliding fit or alternatively the pipe can be securely and tightly clamped to the member 71.

I claim:

1. A jack comprising:

(a) a first pipe threaded at one end thereof;

(b) a first jaw member slidable longitudinally along said first pipe for quick positioning and having means to lock the same at any position therealong;

(c) a mounting bracket having first and second threaded bores extending therethrough parallel to and spaced apart from one another;

(d) a second pipe threaded at one end thereof, said first and second pipes being threaded into said first threaded bore respectively from opposite ends thereof;

(e) a second jaw member slidable along said second pipe;

(f) a threaded rod extending through said second threaded bore in the bracket and rotatably connected to said second jaw member to move the same during rotation of the threaded rod, said threaded rod being axially parallel with said pipes; and (g) handle means swingingly connected at one end thereof to one end of said threaded rod for rotating the same, said first and second jaw member each having an article engaging face and wherein said faces are directed away from one another.

2. A jack as defined in claim 1 wherein each of said first and second threaded bores are provided by sleeves having internal threaded molded therein and wherein said sleeves are press fit into recesses in said bracket.

3. A jack as defined in claim 1 wherein said handle has at least one formation thereof adapted for engagement by a wrench to turn the handle.

4. A jack as defined in claim 2 including means on said sleeves engaging said bracket to prevent rotation of the sleeves in their respective recesses in the bracket.

5. A jack as defined in claim 4 including means preventing axial displacement of the sleeves in their respective recesses in the bracket.

6. A jack as defined in claim 5 wherein one of said sleeves is prevented against axial displacement in one direction and wherein the other of said sleeves is prevented against axial displacement in an opposite direction.

7. A jack comprising:

(a) a first pipe threaded at one end thereof;

(b) a first jaw member slidable longitudinally along said first pipe for quick positioning and having means to lock the same at any position therealong;

(c) a mounting bracket having first and second internal threaded portions of standard pipe thread tapped on a common centerline from opposite faces of said bracket and a further threaded bore parallel to said common centerline and spaced from said first and second portions;

(d) a second pipe threaded at one end thereof, said first and second pipes being threaded into respective ones of said first and second axially aligned threaded portions of said bracket;

(e) a second jaw member slidable along said second pipe;

(f) a threaded rod extending through said further threaded bore in said bracket and rotatbly connected to said second jaw member to move the same during rotation of the threaded rod, said threaded rod being axially parallel with said pipes; and (g) handle means swingingly connected at one end thereof to one end of said threaded rod for rotating the same, said first and second jaw members each having an article engaging face and wherein said faces are directed away from one another.

* * * * *